United States Patent [19]

Benoit

[11] 4,216,994

[45] Aug. 12, 1980

[54] TABLET SIDE ARM FOR CHAIRS

[75] Inventor: Roland A. Benoit, Danielson, Conn.

[73] Assignee: Inter Royal Corporation, New York, N.Y.

[21] Appl. No.: 918,869

[22] Filed: Jun. 26, 1978

[51] Int. Cl.[2] ..... A47B 17/06

[52] U.S. Cl. ..... 297/162; 297/417

[58] Field of Search ..... 297/162, 417

[56] References Cited

U.S. PATENT DOCUMENTS

| | | | |
|---|---|---|---|
| 3,099,479 | 7/1963 | Banke | 297/162 X |
| 3,233,939 | 2/1966 | Chapman | 297/162 |
| 3,857,605 | 12/1974 | Fantoni | 297/162 |
| 3,968,992 | 7/1976 | Hogan | 297/162 |

FOREIGN PATENT DOCUMENTS

| | | | |
|---|---|---|---|
| 56674 | 12/1974 | Australia | 297/162 |
| 599784 | 11/1959 | Italy | 297/162 |

*Primary Examiner*—William H. Schultz
*Assistant Examiner*—Peter A. Aschenbrenner

[57] ABSTRACT

Tablet side arm assembly for mounting on a chair, in which a side arm positionable at the side of a chair is arranged for stably pivotally connecting thereto a floating tablet, e.g. having a planar writing or working surface thereon, on a pivot axis situated with respect to the side arm for displacing the tablet along a rotational movement path sequentially forwardly and outwardly and thence downwardly and backwardly relative to the horizontal from a substantially horizontal working position extending generally crosswise of the side arm to a substantially vertical storage position extending generally laterally of the side arm, such as by providing an angular offset portion on the side arm extending in an offset plane at an angle, e.g. of about 45 degrees, to the horizontal to which an angle bracket carrying the tablet is pivotally connected via a pivot pin extending along the pivot axis, and also preferably extending normal to the offset plane and within a substantially vertical transverse plane arranged substantially parallel to the corresponding chair back portion, and optionally including stops limiting pivotal movement of the tablet to an arc, e.g. of about 180 degrees, corresponding to the extent of the rotational movement path between the working and storage positions.

37 Claims, 8 Drawing Figures

TABLET SIDE ARM FOR CHAIRS

The present invention relates to a stable support for mounting a floating tablet on a chair, and more particularly to a tablet side arm assembly comprising a side arm positionable at the side of a chair and means for stably pivotally connecting a floating tablet having a working surface thereon to the side arm on a pivot axis specifically situated with respect to the side arm for displacing the tablet along a specially oriented rotational movement path.

Floating tablet support assemblies of various types are known. As is clear from U.S. Pat. Nos. 533,592 (Hood); 534,469 (Demarest); 3,140,894 (Hicke); 3,197,254 (Hendrickson); 3,479,084 (Van Ryn); 3,547,488 (Barnes); 3,556,588 (Monyer et al); and 3,598,442 (Miller); the pertinent prior arrangements have generally involved complex and expensive constructions utilizing ball and socket, or other dual or compound pivot or hinge, type connections, or the like.

U.S. Pat. No. 3,857,605 (Fantoni), on the other hand, provides a single pivot connection for mounting the floating tablet on a side arm, but the pivot axis is awkwardly arranged at an angle offset both upwardly and outwardly of the side arm and chair seat, which is more or less critical for proper performance to move the tablet rotatably sequentially backwardly, outwardly and downwardly from a horizontal writing position to a vertical non-use position, and which requires a complex and expensive side arm construction to accommodate and adequately support the pivot pin connection for orientation at the stated pivot axis angle.

It is among the objects and advantages of the present invention to overcome the foregoing prior art disadvantages and deficiencies, and to provide a stable support for mounting a floating tablet on a chair which is simple, rigid and durable in construction, comparatively inexpensive to fabricate and assemble from readily available components and materials, attractive in appearance, and relatively easy to use.

It is among the additional objects and advantages of the present invention to provide a support of the stated type utilizing a minimum of necessary parts, and contemplating a specifically formed side arm for stably pivotally connecting a tablet thereto, having provision for particularly orienting the pivot axis with respect to the side arm for displacing the tablet along a rotational movement path sequentially forwardly and outwardly and thence downwardly and backwardly relative to the horizontal from a substantially horizontal working position extending more or less crosswise of the side arm to a substantially vertical storage position extending more or less laterally of the side arm.

It is among the further objects and advantages of the present invention to provide a support of the stated type which limits pivotal movement of the tablet to an arc of preferably substantially about 180 degrees and corresponding to the extent of the rotational movement path between the working and storage positions, and especially with the pivot axis disposed at an angle of about 45 degrees to the horizontal, and more especially extending in a substantially vertical transverse plane arranged substantially parallel to the corresponding chair back portion.

It is among the still further objects and advantages of the present invention to provide a support of the stated type in which the side arm is specifically shaped for accommodating pivot means thereon for stably pivotally connecting the tablet thereto on such pivot axis, and preferably which conveniently contains seating means for optionally removably seating the side arm on a portion of a chair.

It is among the still further objects and advantages of the present invention to provide a tablet side arm assembly including a side arm positionable at the side of a chair and a floating tablet privotally connected thereto on such pivot axis, with special pivot means being provided to achieve simplified interconnection between the parts for long lasting and essentially trouble free operation, and especially for complete stability and freedom from play of the tablet when in working position.

Other and further objects and advantages of the invention will become apparent from a study of the within specification and accompanying drawings, in which:

FIGS. 1 to 3 are schematic perspective views of a chair on which a tablet side arm assembly according to one embodiment of the invention is mounted, showing the manner of displacing the tablet along a rotational movement path sequentially forwardly and outwardly and thence downwardly and backwardly relative to the horizontal from a substantially horizontal working position extending more or less crosswise of the side arm to a substantially vertical storage position extending more or less laterally of the side arm;

Figure 8:
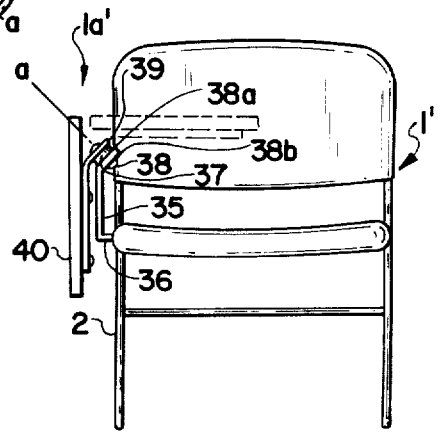
Figure 7:
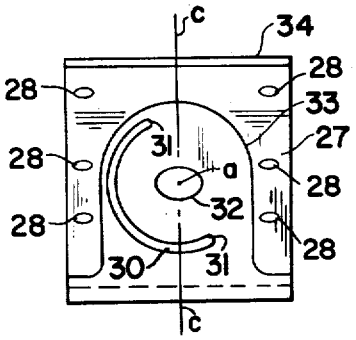
Figure 4:
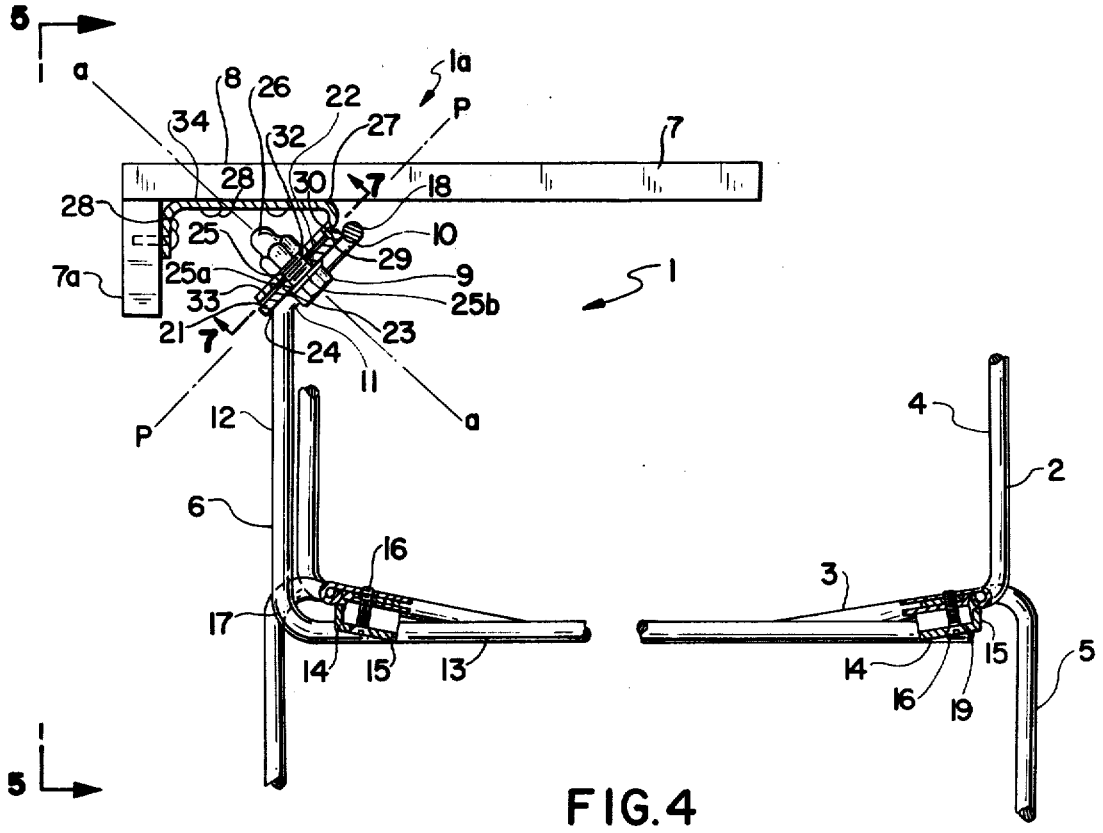
FIG. 4 is a schematic front elevational view partially in section of the pertinent portion of the chair of FIGS. 1 to 3, showing details of construction of the side arm and the stable pivotal connection of the tablet thereto as well as the manner of attachment of the side arm to the frame of the chair.
Figure 5:
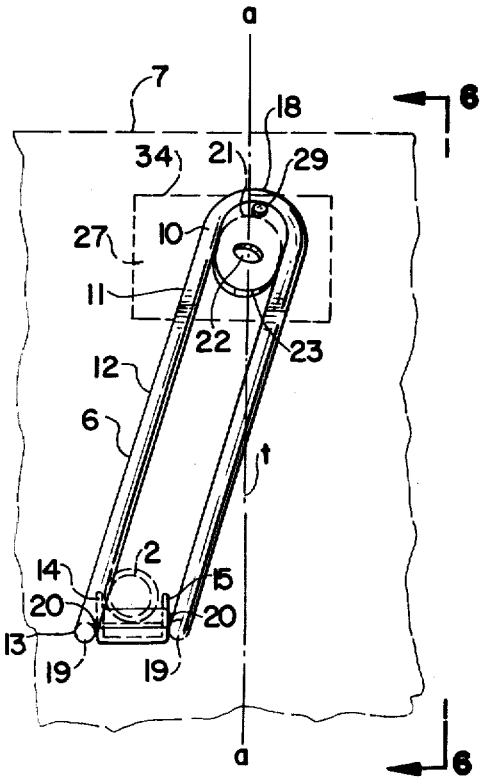
FIG. 5 is a schematic side view of the side arm taken along the line 5—5 of FIG. 4, showing the forward slant thereof, the seating means for attaching the side arm to the frame of the chair, and in phantom the vertical disposition of the tablet laterally outwardly thereof when in storage position.
Figure 6:
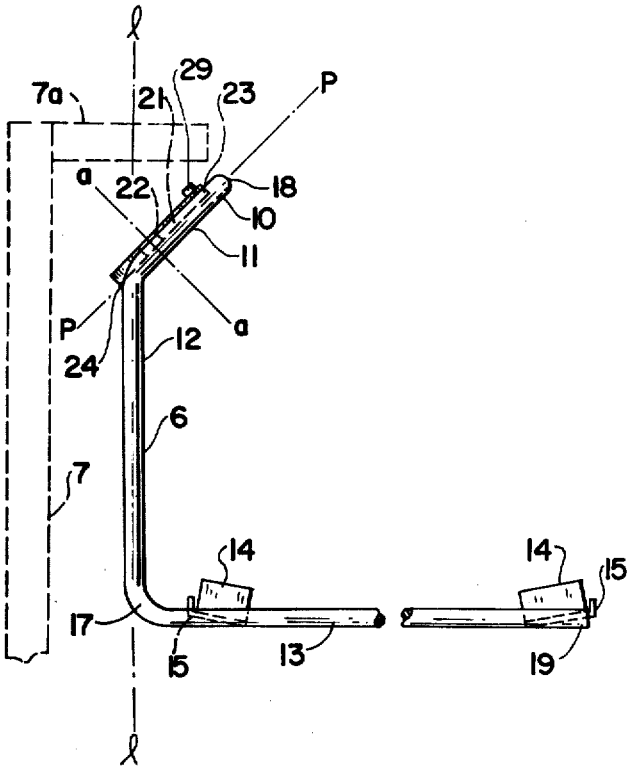

FIG. 6 is a schematic front elevational view of the side arm taken along the line 6—6 of FIG. 5, showing the offset angular orientation of the upper portion thereof at which the pivotal connection for the tablet is arranged and a lug for limiting the range of pivotal movement of such tablet, as well as the disposition of the seating means on the lower portion of the side arm for attaching the same to the frame of the chair;

FIG. 7 is a schematic view of the angle bracket for carrying the tablet taken along the line 7—7 of FIG. 4, isolated from the adjacent pivotal parts, and showing the bearing face thereof and the arcuate guideway or recess therein for limiting the range of pivotal movement of the tablet in conjunction with the lug on the side arm; and FIG. 8 is a schematic view of a chair on which a modified tablet side arm assembly according to a further embodiment of the invention is mounted, showing the relation between the side arm and the tablet bracket and the manner of pivotally interconnecting the adjacent parts in stable arrangement.

In accordance with one feature of the present invention, a stable support for mounting a floating tablet on a chair is provided which includes a side arm positionable at the side of the chair and specifically spatially disposed pivot axis orienting receiving means arranged on the side arm.

Such receiving means are particularly arranged on the side arm for axially receiving pivot means for pivotally connecting the floating tablet to the side arm on a pivot axis situated with respect to the side arm for displacing the tablet advantageously along a rotational movement path sequentially forwardly and outwardly and thence downwardly and backwardly relative to the horizontal from a substantially horizontal working position extending generally crosswise of the side arm to a substantially vertical storage position extending generally laterally of the side arm.

In this regard, the pivot axis is disposed at an acute angle of preferably about 45 degrees to the horizontal. More particularly, the side arm extends in a substantially vertical lateral plane directed substantially forwardly to backwardly relative to the horizontal and the pivot axis which is disposed at such acute angle preferably also extends in a substantially vertical transverse plane arranged substantially normal to such lateral plane.

The pivot axis orienting receiving means suitably includes an angular offset portion on the side arm extending in an offset plane at a concordant acute angle of preferably about 45 degrees to the horizontal. This permits the receiving means to receive the pivot means axially thereat with the pivot axis extending correspondingly substantially normal to the offset plane to achieve the stated pivot axis orientation desired.

According to a particular aspect of the construction of the invention, the side arm suitably includes a substantially upwardly directed portion containing the angular offset portion and a substantially horizontally directed portion containing seating means for seatingly attaching the side arm on a portion of the chair. The seating means may comprise for instance channel supports for supportingly engaging a corresponding structural portion of the chair. Preferably, the upwardly directed portion of the side arm is also inclined forwardly relative to the horizontal.

In particular, the angular offset portion on the side arm is desirably provided with a positioning journal portion extending in the offset plane and has a journal bearing or bore therein coaxially arranged with respect to the pivot axis for axially receiving thereat the pivot means for pivotally connecting the floating tablet to the side arm.

In accordance with another feature of the invention, the support includes the side arm and pivot means in combination therewith. The pivot means are arranged on the side arm for pivotally connecting the floating tablet to the side arm on a pivot axis situated as stated above for the desired purposes. The pivot means suitably include a pivot pin extending along such pivot axis, and preferably also stop means for limiting pivotal movement of the tablet to an arc of preferably substantially 180 degrees and corresponding to the extent of the rotation movement path between the working and storage positions.

In addition, a bracket may be arranged in pivotal connection with the side arm for carrying the tablet for pivotal movement therewith. The bracket may be an angle bracket pivotally connected to the offset portion via the pivot pin, with the pivot pin concordantly extending along the stated pivot axis and preferably arranged substantially normal to the offset plane thereof as well. The pivot pin is desirably axially operatively received in the journal bearing or bore of the positioning journal portion of the angular offset portion.

Such positioning journal portion may be advantageously provided in the form of a stationary contact washer such that the bracket is stably arranged with its bearing face in rotatably slidable supporting contact relation therewith and is pivotally connected thereto at the journal bearing therein via the pivot pin. Hence, the stop means may accordingly include an upstanding lug or boss on the contact washer projecting into an opposed cooperating arcuate guideway or recess in the bearing face of the bracket. The guideway appropriately extends along an arc of preferably substantially about 180 degrees relative to the pivot axis and is bounded at the corresponding guideway ends by lug engaging limiting means.

In accordance with a further feature of the invention, a tablet side arm assembly is provided which includes the side arm in combination with a floating tablet such as a tablet having a planar working surface or writing surface thereon. The tablet is stably pivotally connected to the side arm on such pivot axis situated as stated above for the desired purposes, and the assembly preferably includes the aforesaid angular offset portion, positioning journal portion, bracket, pivot pin and stop means in appropriate arrangement as desired.

In accordance with still another feature of the invention, a chair assembly is provided which contemplates seat, back and leg portions forming a chair unit, and in combination therewith a tablet side arm assembly of the stated type attached via the side arm at the side of the chair unit for example by way of seating means on the substantially horizontally directed portion of the side arm.

Figure 1:
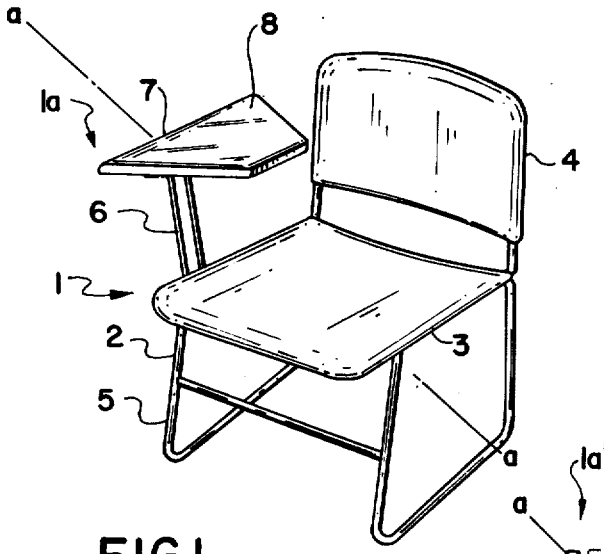
Figure 2:
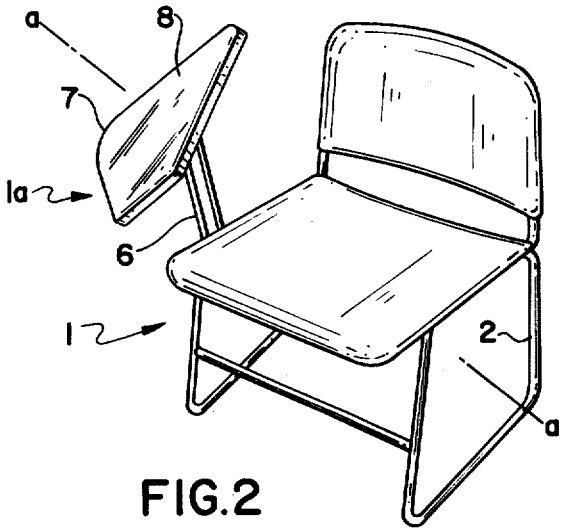
Figure 3:
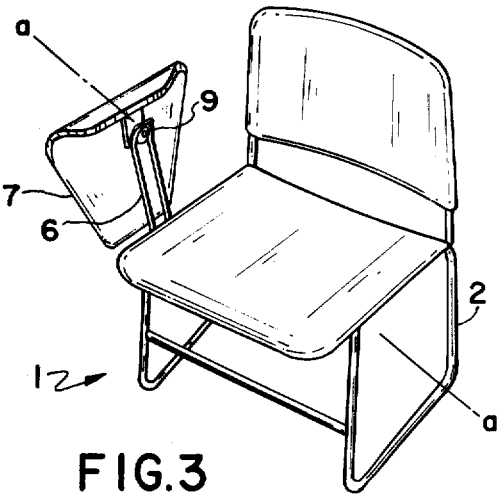

Referring to the drawings, and especially FIGS. 1 to 3, a chair assembly 1 is shown according to one embodiment of the invention, comprising a chair frame 2 having a generally horizontal seat portion 3, a generally vertical transverse back portion 4 and a composite leg portion 5 forming a chair unit, on which the tablet side arm assembly 1*a* is positioned.

Tablet side arm assembly 1*a* includes the slightly forwardly inclined side arm 6 positioned at the side of the chair, and the floating tablet 7 having a planar working surface or writing surface 8 thereon. Pivot means 9 (FIG. 3) pivotally interconnect tablet 7 to side arm 6 on pivot axis a.

As is clear from FIGS. 1 to 3, considered in order, pivot axis a is situated with respect to side arm 6 for displacing tablet 7 along a rotational movement path sequentially forwardly and outwardly (FIG. 2) and thence downwardly and backwardly relative to the horizontal from a substantially horizontal working position or writing position (FIG. 1) extending more or less crosswise of and generally overlying the side arm to a substantially vertical storage position or non-working position (FIG. 3) extending more or less laterally of the side arm.

Thus, the user sitting in the chair can easily move the floating tablet from one position to the other by way of a simple and inexpensive constructional connection along a movement path which is conveniently to the front and side of the chair and thus out of range of interference with the body of the user, while at the same time providing immediate access to the working surface when the tablet is placed in its working position.

As may be seen from FIGS. 4 to 6, pivot axis orienting receiving means 10 are provided for axially receiving pivot means 9 on pivot axis a. Receiving means 10 include angular offset portion 11 rigidly disposed on side arm 6 which extends substantially in an offset plane p at an angle to the horizontal of preferably about 45 degrees. By axially receiving pivot means 9 so that pivot axis a extends substantially normal to the offset plane p, the offset portion 11 will in turn cause such pivot axis to be disposed at a corresponding angle to the horizontal of concordantly preferably about 45 degrees.

Furthermore, since side arm 6 is suitably arranged to extend in a substantially vertical lateral plane 1 directed substantially forwardly to backwardly relative to the horizontal, the pivot axis a desirably may correspondingly extend in a substantially vertical transverse plane t arranged substantially normal to such lateral plane 1 (cf. FIGS. 5 and 6).

More specifically, the pivot axis a may extend in substantially vertical transverse plane t (lying in the plane of the paper regarding FIGS. 4 and 6), and simultaneously in an inclined plane arranged substantially normal to and in intersecting relation with transverse t (and correspondingly normal to the plane of the paper regarding FIGS. 4 and 6), as well as disposed at an angle of about 45 degrees, on the one hand, to the horizontal and, on the other hand, to the substantially vertical lateral plane 1 (lying in the plane of the paper regarding FIG. 5 and correspondingly normal to the plane of the paper regarding FIGS. 4 and 6). The pivot axis a in effect constitutes the line of intersection between the inclined plane, which extends substantially normal to the offset plane p (cf. FIG. 4), and the transverse plane t.

Preferably, side arm 6 includes a substantially upwardly directed portion 12 containing offset portion 11 and a substantially horizontally directed portion 13 containing seating means 14 thereon for seating side arm 6 on a portion of the chair frame 2. The side arm accordingly constitutes an L-shaped rigid unitary support.

It will be seen that in fact the angular offset portion 11 extends upwardly and laterally from the upwardly directed portion 12 of the side arm 6 in an inwardly facing direction relative to the chair side and in the same laterally facing direction as the laterally facing positioning means of the side arm, e.g. as constituted by the horizontally extending portion 13 vertically downwardly spaced from the angular offset portion 11, for positioning the side arm at the adjacent side of the chair. Hence, the side arm has laterally facing positioning means thereon disposed in substantially transverse laterally facing direction for positioning the side arm at the appropriate side of the chair, as well as pivot axis orienting receiving means, e.g. including the angular offset portion 11, extending upwardly and laterally from the side arm in the same corresponding facing direction as that of the laterally facing positioning means. As the artisan will appreciate, such vertically spaced apart dual unilaterally or unidirectionally transversely facing means will contribute compact structural support for the floating tablet 7 and at the same time conserve space at the side of the chair without interfering with the normal use of the tablet or its movement between the working and storage positions.

Side arm 6, as constituted by such L-shaped unitary support, may be conveniently formed from a tube or rod bended upon itself, e.g. at the angular offset portion 11, and particularly such that the upwardly directed portion 12 is inclined forwardly at an angle of for instance about 70 degrees to the horizontal (see FIG. 5), while the bended portions of the rod extend in more or less continuous side by side or parallel relation and terminate at their free ends at the horizontally directed portion 13 selectively adjacent the opposite side of the corresponding chair on which the table side arm assembly 1*a* is to be mounted (see FIG. 6).

For this purpose, horizontally directed portion 13 is desirably provided with spaced apart seating means 14 which include channel supports 15 adapted to engage supportingly a corresponding structural portion of the chair frame 2. Channel supports 15 are positioned on portion 13 and may be specifically arranged in upwardly and laterally outwardly inclined relation to the horizontal for readily accommodating the corresponding configuration of the particular tubular chair frame 2, as and if desired (see FIG. 4).

Releasable attachment means such as screws 16 or the like may be utilized for removably mounting side arm 6 onto the chair frame 2 at channel supports 15. Alternatively, such screws may be suitably welded in place to provide permanent attachment means thereat, as desired.

As thus constituted, the side arm 6 provides an efficient and convenient rigid unitary support for a floating tablet which is positionable at the side of the chair, and optionally which is readily removably mountable thereon simply by removing the screws 16 or the like from the seating means 14, i.e. when not permanently attached thereat.

It should be noted in this regard that the rigid structural integrity of the double rod or tube form of side arm 6 as shown is enhanced, not only inherently by the presence of bends at the angular offset portion 11 and the transitional area at the corner 17 between the upwardly directed portion 12 and the horizontally directed portion 13, but also by reason of the arcuate bended end 18 defined at the upper terminus of receiving means 10 and the interposed spaced apart channel supports 15 located between the side by side portions of such rod or tube adjacent the free ends 19 and in turn appropriately secured to horizontally directed portion 13 therealong by suitable welding 20 or the like (see FIG. 5).

Advantageously, angular offset portion 11 is provided with a positioning journal portion 21 thereon extending more or less in the offset plane p and having a journal bearing or bore 22 therein. Journal bearing 22 is coaxially arranged with respect to pivot axis a for axially receiving pivot means 9 thereat. The positioning journal portion 21 may be desirably constituted as a stationary elongate rigid contact washer 23 containing such bearing 22 therein and suitably fixed to the offset portion 11 by welding 24 or the like.

Pivot means 9 includes a pivot pin or bolt 25, extending along pivot axis a through journal bearing 22 of contact washer 23 and capped by an acorn nut or the like 26, for pivotally connecting bracket 27 to offset portion 11. Bracket 27 is suitably connected to floating tablet 7 via screws or the like 28 for carrying the tablet so as to affect the desired pivotal movement thereof along the stated rotational movement path from the horizontal working position shown in FIG. 4 to the vertical storage position shown in phantom in FIGS. 5 and 6.

Bracket 27 is advantageously arranged as a rigid angle bracket with its bearing face in rotatably slidable supporting contact relation with positioning journal portion 21 at the opposed coacting face of stationary contact washer 23 and maintained in pivotal connection thereat by pivot pin 25. This construction insures a stable and play-free interfacially supporting articulation especially as regards the tablet disposition when in working position.

The pivot means furthermore advantageously contemplate the provision for stop means thereat to limit pivotal movement of the tablet to an arc of concordantly preferably about 180 degrees and corresponding to the extent of the rotational movement path between the working and storage positions. Such stop means may include, for instance, an upstanding lug or boss 29 on contact washer 23 projecting into an opposed cooperating guideway or recess 30 on bracket 27. Such guideway 30 extends along an arc of concordantly preferably about 180 degrees relative to pivot axis a and is bounded at the corresponding guideway ends by lug engaging limiting walls 31,31 (see FIG. 7). Of course, other suitable stop means may be employed as the artisan will appreciate.

As may be readily seen in FIG. 7, guideway 30 is arranged along an arc of about 180 degrees as aforesaid, yet selectively offset from the normal central plane c of bracket 27 which contains pivot axis a and which bisects the accommodating journal or bore 32 therein for receiving the corresponding portion of pivot pin 25, for example by a differential of about 26 degrees and 30 minutes. This offset arc differential will suitably result in proper squared off disposition of the tablet 7 in working position and in storage position, considering the forward incline of the upwardly directed portion 12 of side arm 6, the angular disposition of offset portion 11 in relation to the remainder of side arm 6, and the desired angle of pivot axis a in relation to the horizontal and more particularly in relation to the transverse plane t. In this regard, at the working position of tablet 7, the normal central plane c of bracket 27 desirably coincides with transverse plane t.

Bracket 27 is conveniently provided as a flat rigid plate type element suitably bended to form inclined bearing face journal portion 33 containing bore 32 and L-shaped mounting portion 34 rigidly arranged at an acute angle therebetween to permit proper mounting and alignment of the parts. While inclined journal portion 33 through which pivot pin 25 passes will extend with its bearing face more or less along offset plane p, L-shaped mounting portion 34 will be rigidly disposed at a connecting bend orientation angle of concordantly preferably about 45 degrees relative thereto yet will also be provided with a right angle bend rigidly therein not only to permit the tablet 7 to be mounted thereon more securely but also to be reinforced thereby along the conveniently providable tablet extension portion or armrest *7a*.

It should be noted that guideway 30 is efficiently formed as a recess or groove having a lug engaging countersupporting closed underside (FIGS. 4 and 7) which extends radially outwardly of the pivot axis a in the inclined journal portion 33 of bracket 27, so as to engage supportingly the stationary lug 29 which is correspondingly disposed on the contact washer 23 radially outwardly of the pivot axis (FIGS. 4 to 6). Perforce, the engaging relation of the lug 29 and the closed underside of the groove or recess 30 provides additional support radially outwardly of the pivot axis between the pivotally interconnected parts for enhanced stabilization of the connection thereat and which contributes to the distribution and counteracting of the lever force exerted thereon as generated by the tablet 7 when used in working position (cf. FIG. 4).

A simpler constructional execution of the invention is shown in the modification embodiment of FIG. 8 wherein the chair assembly 1' includes the same type chair frame 2 on which the tablet side arm assembly 1*a'* is mounted. Assembly 1*a'* correspondingly includes side arm 35 positioned at the side of the chair and optionally removably connected thereto via screws or the like (not shown) extending through the seating portion 36 thereof.

Side arm 35 may be formed as a unitary flat rigid plate or strap having an angular offset portion 37 pivotally connected via pivot pin 38 or the like to the unitary flat rigid plate or strap type angular bracket 39 carrying the floating tablet 40 on pivot axis a'. Pivot axis a' is situated with respect to side arm 35 for displacing the tablet in similar manner along a rotational movement path sequentially forwardly and outwardly thence downwardly and backwardly relative to the horizontal from the substantially horizontal working position, shown in phantom, extending crosswise of the side arm to the substantially vertical storage position, as shown, extending laterally of the side arm.

The opposed flat coacting bearing facial potions of rigid offset portion 37 and rigid bracket 39, arranged in rotatable slidable supporting contact relation with each other about pivot pin 38, similarly constitute a construction which insures a stable and play-free interfacially supporting articulation as noted above.

Suitable washers may be provided between the pivotally connected parts in both of the aforesaid embodiments to reduce friction and binding and in turn prolong wear at the corresponding articulated interconnection, as the artisan will appreciate. Specifically, conventional nylon or other smooth minimum friction type plastic washer 25*a* and spring washer 25*b* may be mounted at pivot pin 25 (see FIG. 4) and similar washers 38*a* and 38*b* may be mounted at pivot pin 38 (see FIG. 8) for enhanced pivotal operation.

Of course, other similar forms and constructional arrangements of the coacting parts may be utilized according to the invention for achieving the desired results. In all these cases, the pivotal connection between the side arm and floating tablet will be arranged to provide a single pivot axis situated with respect to the side arm for displacing the tablet along the stated rotational movement path. Also, the rotatably slidable supporting contact relation between the rigid offset portion and rigid bracket will insure safety in use, and adequate rigidity, stability and freedom from play of the parts and especially of the tablet when situated in working position.

Thus, according to the invention a stable support for mounting a floating tablet, preferably removably, on a chair is provided, which is simple, rigid and durable in construction, comparatively inexpensive to fabricate and assemble, attractive in appearance, and relatively easy to use. Moreover, the construction may be conveniently produced from readily available components and materials, using a minimum of manufacturing steps and by way of conventional equipment and tooling. Clearly, the construction requires a bare minimum of necessary parts, yet the same coact in a manner insuring long lasting and essentially trouble free operation. The parts remain sufficiently out of the way of the user in terms of the rotational movement path contemplated for ease in changing the tablet from working to storage position and the pivotal connection contemplated insures that the tablet when in working position is completely stable and free from play.

It will be realized that the instant specification and drawings are set forth by way of illustration and not limitation, and that various modifications and changes may be made therein without departing from the spirit and scope of the present invention which is to be limited solely by the scope of the appended claims.

What is claimed is:

1. Support for mounting a floating tablet on a chair comprising a side arm positionable at the side of a chair and having laterally facing positioning means thereon disposed in substantially transverse laterally facing direction for positioning the side arm at such side of the chair, and pivot axis orienting receiving means on the side arm vertically spaced from the laterally facing positioning means and extending upwardly and laterally therefrom in the same corresponding facing direction as that of the laterally facing positioning means and arranged for axially receiving pivot means for pivotally connecting a floating tablet to the side arm on a pivot axis situated with respect to the side arm for displacing the tablet along a rotational movement path sequentially forwardly and outwardly and thence downwardly and backwardly relative to the horizontal from a substantially horizontal working position extending crosswise of the side arm to a substantially vertical storage position extending laterally of the side arm.

2. Support according to claim 1 wherein the pivot axis is at an angle of about 45 degrees to the horizontal.

3. Support according to claim 2 wherein the side arm extends in a substantially vertical lateral plane directed substantially forwardly to backwardly relative to the horizontal, and the pivot axis extends in a substantially vertical transverse plane arranged substantially normal to the lateral plane and simultaneously extends in an inclined plane arranged substantially normal to and in intersecting relation with the transverse plane and disposed at an angle of about 45 degrees to the lateral plane, whereby such pivot axis constitutes the line of intersection between the inclined plane and transverse plane.

4. Support according to claim 1 wherein the pivot axis orienting receiving means includes an angular offset portion on the side arm extending upwardly and laterally therefrom in said laterally facing direction in an offset plane at an angle to the horizontal for axially receiving pivot means having a pivot axis extending substantially normal to the offset plane.

5. Support according to claim 4 wherein the offset plane is at an angle of about 45 degrees to the horizontal.

6. Support according to claim 5 wherein the side arm extends in a substantially vertical lateral plane directed substantially forwardly to backwardly relative to the horizontal, and the pivot axis extends in a substantially vertical transverse plane arranged substantially normal to the lateral plane and simultaneously extends in an inclined plane arranged substantially normal to and in intersecting relation with the transverse plane and disposed at an angle of about 45 degrees to the lateral plane, whereby such pivot axis constitutes the line of intersection between the inclined plane and transverse plane.

7. Support according to claim 4 wherein the side arm includes a substantially upwardly directed portion containing the angular offset portion extending upwardly and laterally therefrom in said laterally facing direction, and a substantially horizontally directed portion vertically downwardly spaced from the angular offset portion and comprising the positioning means and extending in said laterally facing direction and containing seating means for seating the side arm on a portion of a chair.

8. Support according to claim 7 wherein the seating means include channel supports for supportingly engaging a corresponding structural portion of a chair.

9. Support according to claim 7 wherein the upwardly directed portion of the side arm is inclined forwardly relative to the horizontal.

10. Support according to claim 4 wherein the angular offset portion on the side arm is provided with a positioning journal portion extending in the offset plane and having a journal bearing therein coaxially arranged with respect to the pivot axis for axially receiving thereat and pivot means for pivotally connecting the floating table to the side arm, and a stationary lug is disposed on the journal portion radially outwardly of the pivot axis and projecting upwardly from the offset plane for guiding engagement with a corresponding guideway on the pivot means for pivotally connecting the floating tablet to the side arm.

11. Support for mounting a floating tablet on a chair comprising a side arm positionable at the side of a chair, and pivot means on the side arm and arranged for pivotally connecting a floating tablet to the side arm on a pivot axis situated with respect to the side arm for displacing the tablet along a rotational movement path sequentially forwardly and outwardly and thence downwardly and backwardly relative to the horizontal from a substantially horizontal working position extending crosswise of the side arm to a substantially vertical storage position extending laterally of the side arm, the pivot means including an angle bracket having a mounting portion arranged for carrying the floating tablet for pivotal movement therewith and an inclined journal portion rigidly connected to the mounting portion and extending at an acute angle thereto and pivotally connected to the side arm.

12. Support according to claim 11 wherein the pivot means includes a pivot pin extending along the pivot axis and through the inclined journal portion of the bracket.

13. Support according to claim 11 wherein the pivot means includes stop means for limiting pivotal movement to an arc corresponding to the extent of the rotational movement path between the working and storage positions of the tablet.

14. Support according to claim 11 wherein the inclined journal portion of the bracket extends at an angle of about 45 degrees to the mounting portion of the bracket.

15. Support according to claim 11 wherein the side arm includes an angular offset portion extending in an offset plane at an angle to the horizontal, and the pivot means is axially received on the offset portion and includes a pivot pin extending along the pivot axis and through the inclined journal portion of the bracket.

16. Support according to claim 15 wherein the pivot pin extends substantially normal to the offset plane of the offset portion and the inclined journal portion of the bracket is pivotally connected to the offset portion via the pivot pin.

17. Support according to claim 16 wherein the pivot means includes stop means for limiting pivotal movement to an arc of substantially 180 degrees corresponding to the extent of the rotational movement path between the working and storage positions of the tablet.

18. Support according to claim 17 wherein the angular offset portion is provided with a positioning journal portion extending in the offset plane and having a journal bearing therein coaxially arranged with respect to the pivot axis for axially receiving the pivot pin.

19. Support according to claim 18 wherein the positioning journal portion is in the form of a stationary contact washer and the inclined journal portion of the bracket is arranged in rotatably slidable supporting contact relation therewith and pivotally connected at the journal bearing thereof via the pivot pin.

20. Support according to claim 19 wherein the stop means include a stationary lug on the contact washer which is disposed radially outwardly of the pivot axis and which projects into an opposed cooperating arcuate guideway in the inclined journal portion of the bracket which is formed as a groove having a lug engaging counter-supporting closed underside and which extends correspondingly radially outwardly of the pivot axis and along a guideway arc of substantially 180 degrees relative to the pivot axis and which is bounded at the corresponding guideway ends by lug engaging limiting means, for providing additional support between the bracket and contact washer via the engaging relation of the lug and closed underside of the groove.

21. Support according to claim 18 wherein the offset plane is at an angle of about 45 degrees to the horizontal.

22. Support according to claim 21 wherein the side arm extends in a substantially vertical lateral plane directed substantially forwardly to backwardly relative to the horizontal, and the pivot axis extends in a substantially vertical transverse plane arranged substantially normal to the lateral plane and simultaneously extends in an inclined plane arranged substantially normal to and in intersecting relation with the transverse plane and disposed at an angle of about 45 degrees to the lateral plane, whereby such pivot axis constitutes the line of intersection between the inclined plane and transverse plane.

23. Tablet side arm assembly for mounting on a chair comprising a side arm positionable at the side of a chair, and a floating tablet pivotally connected by pivot means to the side arm on a pivot axis situated with respect to the side arm for displacing the tablet along a rotational movement path sequentially forwardly and outwardly and thence downwardly and backwardly relative to the horizontal from a substantially horizontal working position extending crosswise of the side arm to a substantially vertical storage position extending laterally of the side arm, the pivot means including an angle bracket having a mounting portion carrying the floating tablet for pivotal movement therewith and an inclined journal portion rigidly connected to the mounting portion and extending at an acute angle thereto and pivotally connected to the side arm.

24. Assembly according to claim 23 wherein the side arm includes an angular offset portion extending in an offset plane at an angle to the horizontal, and the inclined journal portion of the bracket is pivotally connected to the offset portion via a pivot pin extending along the pivot axis and substantially normal to the offset plane of the offset portion.

25. Assembly according to claim 24 wherein stop means are provided for limiting pivotal movement to an arc of substantially 180 degrees corresponding to the extent of the rotational movement path between the working and storage positions of the tablet.

26. Assembly according to claim 25 wherein the angular offset portion is provided with a positioning journal portion extending in the offset plane and having a journal bearing therein coaxially arranged with respect to the pivot axis for axially receiving the pivot pin.

27. Assembly according to claim 26 wherein the positioning journal portion is in the form of a stationary contact washer and the inclined journal portion of the bracket is arranged in rotatably slidable supporting contact relation therewith and pivotally connected at the journal bearing thereof via the pivot pin.

28. Assembly according to claim 27 wherein the offset plane is at an angle of about 45 degrees to the horizontal.

29. Assembly according to claim 28 wherein the side arm extends in a substantially vertical lateral plane directed substantially forwardly to backwardly relative to the horizontal, and the pivot axis extends in a substantially vertical transverse plane arranged substantially normal to the lateral plane and simultaneously extends in an inclined plane arranged substantially normal to and in intersecting relation with the transverse plane and disposed at an angle of about 45 degrees to the lateral plane, whereby such pivot axis constitutes the line of intersection between the inclined plane and transverse plane.

30. Chair assembly comprising seat, back and leg portions forming a chair unit, and in combination therewith a tablet side arm assembly including a side arm attached at the side of the chair unit, and a floating tablet having a planar working surface and pivotally connected by pivot means to the side arm on a pivot axis situated with respect to the side arm for displacing the tablet along a rotational movement path sequentially forwardly and outwardly and thence downwardly and backwardly relative to the horizontal from a substantially horizontal working position extending crosswise of the side arm to a substantially vertical storage position extending laterally of the side arm, the pivot means including an angle bracket having a mounting portion carrying the floating tablet for pivotal movement therewith and an inclined journal portion rigidly connected to the mounting portion and extending at an acute angle thereto and pivotally connected to the side arm.

31. Assembly according to claim 30 wherein the side arm includes an angular offset portion extending in an offset plane at an angle to the horizontal, and the inclined journal portion of the bracket is pivotally connected to the offset portion via a pivot pin extending along the pivot axis and substantially normal to the offset plane of the offset portion.

32. Assembly according to claim 31 wherein the angular offset portion is provided with a positioning journal portion including a stationary contact washer having a journal bearing therein coaxially arranged with respect to the pivot axis and the inclined journal portion of the bracket is arranged in rotatably slidable supporting contact relation therewith and pivotally connected at the journal bearing thereof via the pivot pin.

33. Assembly according to claim 31 wherein stop means are provided for limiting pivotal movement to an arc of substantially 180 degrees corresponding to the extent of the rotational movement path between the working and storage positions of the tablet.

34. Assembly according to claim 33 wherein the offset plane is at an angle of about 45 degrees to the horizontal.

35. Assembly according to claim 34 wherein the pivot axis extends in a substantially vertical plane arranged substantially parallel to the corresponding chair back portion and simultaneously extends in an inclined plane arranged substantially normal to and in intersecting relation with the transverse plane and disposed at an angle of about 45 degrees to the horizontal, whereby such pivot axis constitutes the line of intersection between the inclined plane and vertical plane.

36. Assembly according to claim 31 wherein washer means are provided on the pivot pin in operative interfacial relation between the offset portion and the inclined journal portion of the bracket.

37. Assembly according to claim 30 wherein an armrest portion is provided on the tablet which is located on the adjacent upper end portion of the tablet when in storage position.

* * * * *